US012766358B2

(12) United States Patent
Ren

(10) Patent No.: US 12,766,358 B2
(45) Date of Patent: Oct. 20, 2026

(54) ROLLER ADJUSTING STRUCTURE OF TREADMILL, AND TREADMILL

(71) Applicant: Xiamen Renhe Sports Equipment Co., Ltd., Fujian (CN)

(72) Inventor: Yangjie Ren, Fujian (CN)

(73) Assignee: Xiamen Renhe Sports Equipment Co., Ltd., Fujian (CN)

( * ) Notice: Subject to any disclaimer, the term of this patent is extended or adjusted under 35 U.S.C. 154(b) by 4 days.

(21) Appl. No.: 19/171,346

(22) Filed: Apr. 6, 2025

(65) Prior Publication Data

US 2026/0115528 A1 Apr. 30, 2026

(30) Foreign Application Priority Data

Oct. 25, 2024 (CN) ..... 202422593987.4

(51) Int. Cl.
*A63B 22/02* (2006.01)

(52) U.S. Cl.
CPC ..... *A63B 22/02* (2013.01); *A63B 22/0285* (2013.01)

(58) Field of Classification Search
CPC .. A63B 22/02; A63B 22/0285; A63B 22/0235
See application file for complete search history.

(56) References Cited

U.S. PATENT DOCUMENTS

| | | | | |
|---|---|---|---|---|
| 5,447,479 | A * | 9/1995 | Gvoich | A63B 22/02 482/64 |
| 5,476,430 | A * | 12/1995 | Lee | A63B 22/02 482/3 |
| 6,042,514 | A * | 3/2000 | Abelbeck | A63B 22/02 482/54 |
| 6,287,240 | B1 * | 9/2001 | Trabbic | A63B 22/02 482/54 |
| 2003/0073543 | A1 * | 4/2003 | Ota | A63B 22/0235 482/54 |
| 2005/0209060 | A1 * | 9/2005 | Lull | A63B 22/0235 482/52 |
| 2008/0312048 | A1 * | 12/2008 | Cassano | A63B 22/0235 482/54 |
| 2012/0010053 | A1 * | 1/2012 | Bayerlein | A63B 22/0285 482/54 |
| 2016/0144225 | A1 * | 5/2016 | Dalebout | A63B 22/02 482/54 |
| 2017/0043209 | A1 * | 2/2017 | Walstead, Jr. | A63B 21/16 |
| 2017/0056716 | A1 * | 3/2017 | Cutler | A63B 22/0285 |
| 2019/0083844 | A1 * | 3/2019 | Bayerlein | A63B 21/00069 |
| 2025/0288862 | A1 * | 9/2025 | Yang | A63B 22/0235 |

* cited by examiner

*Primary Examiner* — Sundhara M Ganesan
(74) *Attorney, Agent, or Firm* — JCIPRNET

(57) ABSTRACT

A roller adjusting structure of a treadmill and a treadmill are provided, and belonging to the technical field of sports equipment. The roller adjusting structure of a treadmill includes a corner-protecting structure, a roller assembly, a running platform support, an adjusting bolt, and a clamping assembly. The roller assembly is threaded to the adjusting bolt by a threaded through hole, the adjusting bolt rotates to drive the roller assembly to move to adjust the tightness of a belt.

10 Claims, 9 Drawing Sheets

ROLLER ADJUSTING STRUCTURE OF TREADMILL, AND TREADMILL

CROSS-REFERENCE TO RELATED APPLICATION

This application claims the priority benefit of China application serial no. 202422593987.4, filed on Oct. 25, 2024. The entirety of the above-mentioned patent application is hereby incorporated by reference herein and made a part of this specification.

TECHNICAL FIELD

The present disclosure relates to the technical field of sports equipment, and in particular to a roller adjusting structure of a treadmill, and a treadmill.

BACKGROUND

Treadmill is a set of equipment for running or walking exercise indoors. The treadmill generally employs a motor to drive a rolling belt to simulate the feeling of running outdoors, which is mainly composed of a belt, a running platform support, a motor, a roller assembly, and other parts. The belt is generally made of a wear-resistant and non-slip material to ensure the comfort and safety of a user when running thereon.

The belt of the treadmill is easy to age and loosen after long-term use, and meanwhile, thermal expansion and cold contraction may occur in the belt due to weather. The tightness of the belt of the treadmill is an important factor affecting the use experience and safety of the treadmill. It is difficult to adjust the tightness of the belt of the treadmill in the related art, leading to poor use experience of the user.

SUMMARY

An embodiment of the present disclosure provides a roller adjusting structure of a treadmill, and a treadmill. The technical solution is as follows:

according to one aspect of the present disclosure, a roller adjusting structure of a treadmill is provided, including a corner-protecting structure, a roller assembly, a running platform support, and an adjusting bolt;

the corner-protecting structure is arranged at one side of one end of the roller assembly, the corner-protecting structure is provided with a first through hole, and the roller assembly is provided with a threaded through hole;

the running platform support is located at one side, away from the corner-protecting structure, of the roller assembly, and the running platform support is provided with a second through hole;

the adjusting bolt passes through the first through hole, the threaded through hole and the second through hole in turn, and a first end part of the adjusting bolt extends out of the second through hole;

the roller adjusting structure of the treadmill further includes a clamping assembly, which is located at one side, away from the threaded through hole, of the second through hole and connected to the running platform support. The clamping assembly is provided with a limit groove, the first end part of the adjusting bolt is located in the limit groove, and a side wall of the first end part is abutted against a groove wall of the limit groove, thus enabling the clamping assembly to clamp the side wall of the first end part of the adjusting bolt.

Alternatively, the first clamping assembly includes a first clamp plate, a second clamp plate, a connecting plate, and a locking structure;

the first clamp plate and the second clamp plate are respectively located at both sides of the first end part of the adjusting bolt, and two ends of the connecting plate are respectively connected to the first clamp plate and the second clamp plate to form the limit groove;

the locking structure is located at one side, away from the connecting plate, of the first end part of the adjusting bolt, and the locking structure is respectively connected to the first clamp plate and the second clamp plate.

Alternatively, one end of the first clamp plate is fixedly connected to the connecting plate, and one end of the second clamp plate is fixedly connected to the connecting plate;

under a condition of not being locked by the locking structure, a shortest distance between one end of the first clamp plate and one end of the second clamp plate is less than or equal to a diameter of the first end part of the adjusting bolt, and the diameter of the first end part of the adjusting bolt is less than or equal to a shortest distance between the other end of the first clamp plate and the other end of the second clamp plate.

Alternatively, the first clamp plate is provided with a third through hole, and the second clamp plate is provided with a fourth through hole;

the locking structure includes a first bolt and a fixing member, the fixing member is located at one side, away from the first clamp plate, of the second clamp plate, and the fixing member is provided with a first mounting hole;

the first bolt passes through the third through hole and the fourth through hole, and an end part of the first bolt extends into the first mounting hole to be threaded to the fixing member.

Alternatively, the fixing member includes a tubular post, the first mounting hole is formed in the tubular post, one end, away from the second clamp plate, of the tubular post is fixedly connected to the running platform support, and one end, close to the second clamp plate, of the tubular post is abutted against the second clamp plate.

Alternatively, the fixing member further includes a plurality of reinforcing ribs, and the reinforcing ribs are located at an outer side of the tubular post, and connected to an outer side wall of the tubular post and the running platform support, respectively.

Alternatively, the roller adjusting structure of the treadmill further includes a belt, the running platform support includes a base portion, and support portions located at both sides of the base portion, the belt is wrapped around the base portion, each support portion comprises a top plate and a side plate connected to each other, and the top plate and the side plate form an accommodating space;

the clamping assembly is arranged in the accommodating space, and the clamping assembly further includes a mounting portion, one end of the mounting portion is connected to the first clamp plate or the second clamp plate, and the other end of the mounting portion is connected to the top plate or the side plate.

Alternatively, the running platform support further includes a support seat, and a second bolt, the support seat is fixedly connected to the top plate, the support seat is provided with a second mounting hole, the mounting portion is provided with a fifth through hole, and the second bolt is mounted in the second mounting hole of the support seat;

one end of the second bolt penetrates through the fifth through hole to fix the mounting portion to the support seat.

Alternatively, each of the first clamp plate and the second clamp plate is an elastic member, the first clamp plate is abutted against one side of the first end part of the adjusting bolt, and the second clamp plate is abutted against the other side of the first end part of the adjusting bolt.

According to another aspect of the present disclosure, the present disclosure provides a treadmill, including the roller adjusting structure of the treadmill above.

The technical solution provided by the embodiments of the present disclosure at least includes the following beneficial effects:

A roller adjusting structure of a treadmill is provided, which includes a corner-protecting structure, a roller assembly, a running platform support, an adjusting bolt, and a clamping assembly. The roller assembly is threaded to the adjusting bolt through a threaded through hole, the adjusting bolt rotates to drive the roller assembly to move to adjust the tightness of a belt. Moreover, the clamping assembly can be used to clamp the adjusting bolt stably to limit the adjusting bolt, thus avoiding a loosening phenomenon of the adjusting bolt caused by external vibration on the roller adjusting structure of the treadmill or deformation of the running platform support, which can improve the stability of the adjusting bolt, and achieve the effect of improving user experience.

In addition, by clamping the adjusting bolt stably by the clamping assembly, the convenience for a user to adjust the tightness of the belt through the adjusting bolt can be improved while improving the stability of the adjusting bolt, and thus the use experience of the user can be further improved.

BRIEF DESCRIPTION OF THE DRAWINGS

To describe the technical solutions in the embodiments of the present disclosure more clearly, the following briefly introduces the accompanying drawings required for describing the embodiments or the prior art. Apparently, the accompanying drawings in the following description show merely some embodiments of the present disclosure, and those of ordinary skill in the art may still derive other drawings from these accompanying drawings without creative efforts.

Explicit embodiments in the present disclosure have been shown through the foregoing accompanying drawings, and more detailed descriptions are provided below. These accompanying drawings and literal descriptions are not intended to limit the scope of the conception of the present disclosure in any manner, but explain the conception of the present disclosure with reference to specific embodiments for those skilled in the art.

DETAILED DESCRIPTION OF THE EMBODIMENTS

To make the objectives, technical solutions and advantages of the present disclosure more clearly, the embodiments of the present disclosure are further described in detail below with reference to the accompanying drawings.

Figure 1:
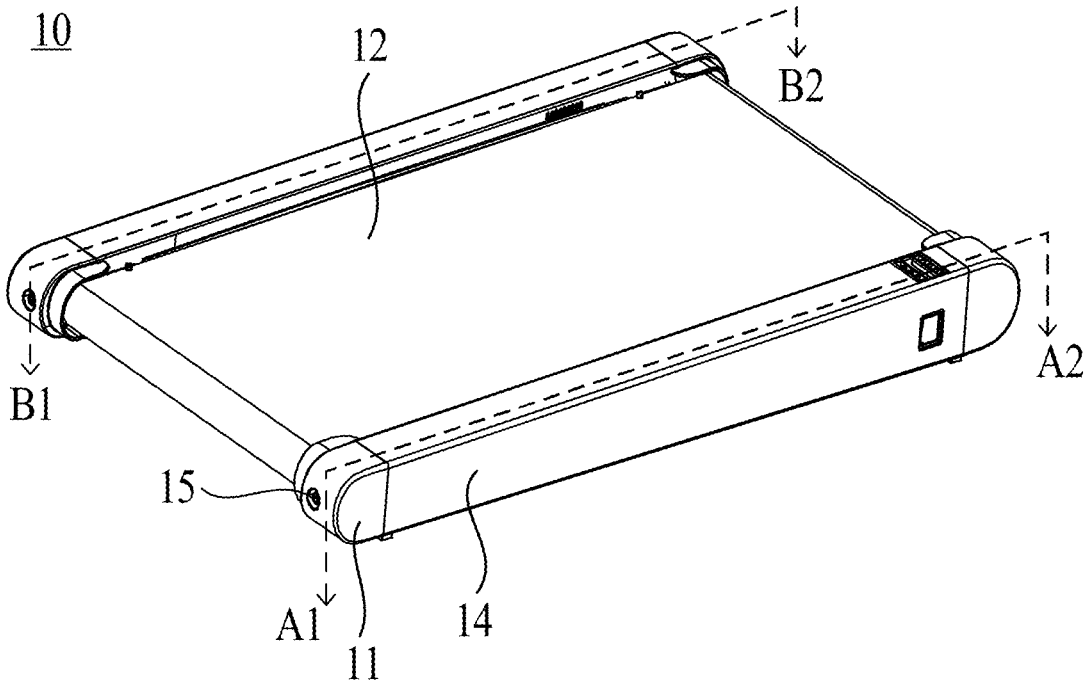
FIG. 1 is a schematic structural diagram of a roller adjusting structure of a treadmill according to an embodiment of the present disclosure.
Figure 2:
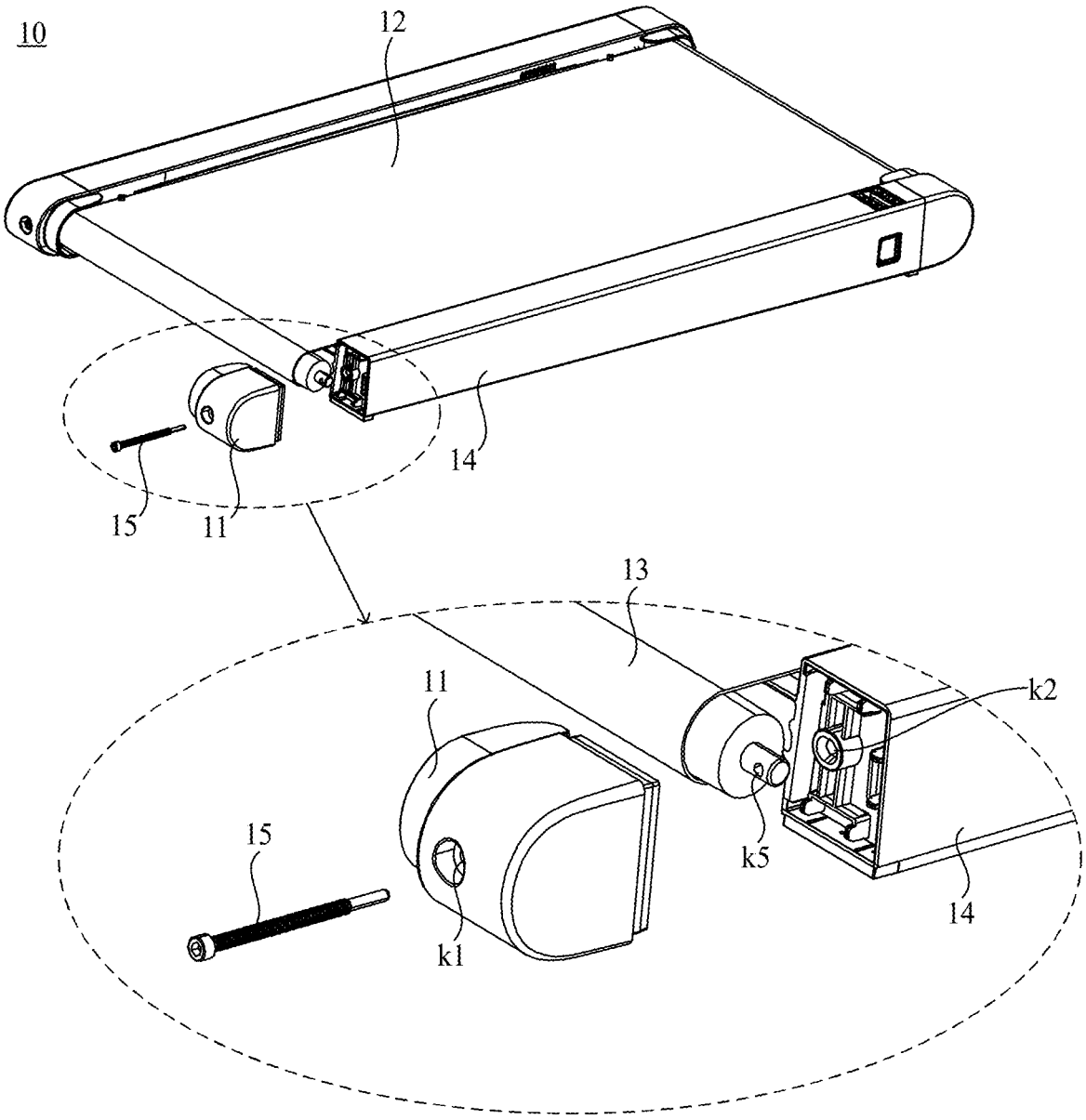
FIG. 2 is a schematic diagram of an exploded structure of a roller adjusting structure of a treadmill shown in FIG. 1.
Figure 3:
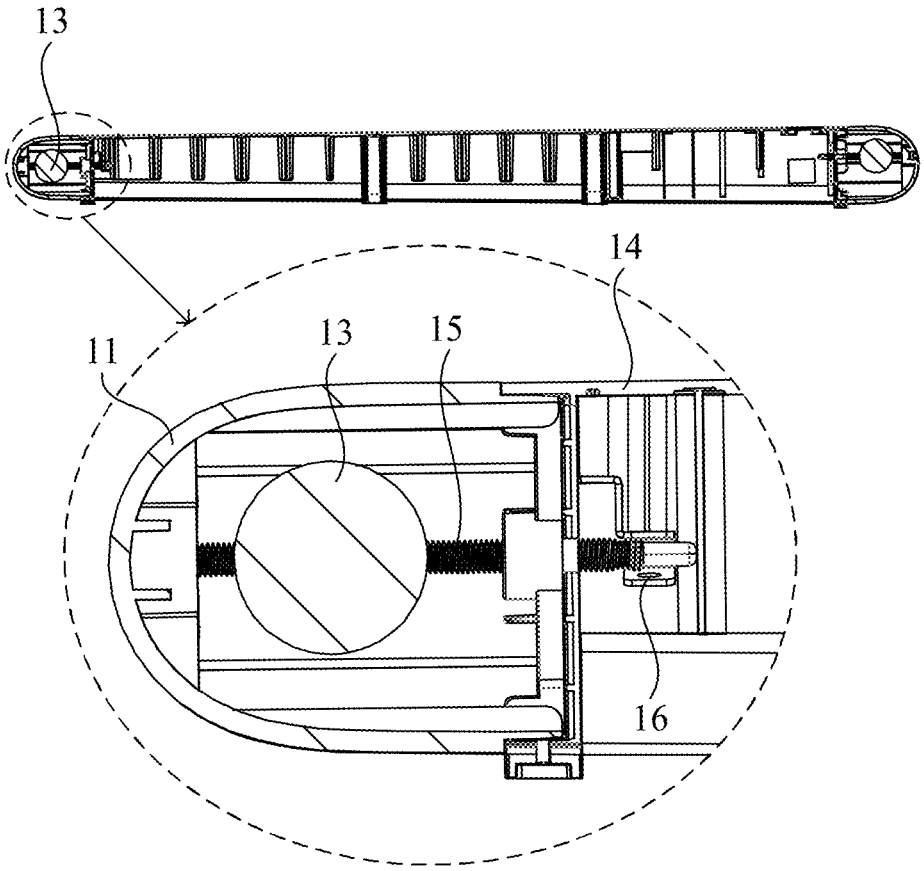
FIG. 3 is a schematic diagram of a sectional structure of a roller adjusting structure of a treadmill shown in FIG. 1 along A1-A2 position.

Referring to FIG. 1, FIG. 2 and FIG. 3, FIG. 1 is a schematic structural diagram of a roller adjusting structure 10 of a treadmill according to an embodiment of the present disclosure; FIG. 2 is a schematic diagram of an exploded structure of a roller adjusting structure 10 of a treadmill shown in FIG. 1; and FIG. 3 is a schematic diagram of a sectional structure of a roller adjusting structure 10 of a treadmill shown in FIG. 1 along A1-A2 position. The roller adjusting structure 10 of a treadmill may include: a corner-protecting structure 11, a roller assembly 13, a running platform support 14, an adjusting bolt 15, and a clamping assembly 16.

The corner-protecting structure 11 may be located at one side of one end of the roller assembly 13, the corner-protecting structure 11 may be provided with a first through hole k1, one end of the roller assembly 13 may be provided with a threaded through hole k5. The running platform support 14 may be located at one side, away from the corner-protecting structure 11, of the roller assembly 13, and the running platform support 14 may be provided with a second through hole k2. The roller adjusting structure 10 of the treadmill may further include a belt 12, part of the belt 12 can be wound around the roller assembly 13, and the roller assembly 13 may be configured to support the belt 12.

The corner-protecting structure 11 may be located at one side, away from the running platform support 14, of the roller assembly 13, and the corner-protecting structure 11 can be configured to protect an end part of the roller assembly 13. The first through hole k1 of the corner-protecting structure 11 may be a smooth through hole, that is, an inner wall of the first through hole k1 does not have threads. The second through hole k2 of the running platform support 14 may be a smooth through hole, that is, an inner wall of the second through hole k2 does not have threads.

The adjusting bolt 15 can pass through the first through hole k1, the threaded through hole k5 and the second through hole k2 in turn, and a first end part of the adjusting part 15 extends out of the second through hole k2. That is, the adjusting bolt 15 can pass through the first through hole k1 of the corner-protecting structure 11, the threaded through hole k5 of the roller assembly 13 and the second through hole k2 of the running platform support 14 in turn.

The adjusting bolt 15 may include a first head, and a first screw. When mounting the adjusting bolt 15, the first screw of the adjusting bolt 15 may pass through the first through hole k1, the threaded through hole k5 and the second through hole k2 in turn, and the first head of the adjusting bolt 15 is located at an outer side of the first through hole k1 of the corner-protecting structure 11, where the size of the first head of the adjusting bolt 15 is larger than a diameter of the first through hole k1 of the corner-protecting structure 11, such that the corner-protecting structure 11 can support the adjusting bolt 15, and a user can rotate the adjusting bolt 15 conveniently through the first head of the adjusting bolt 15 at the outer side of the first through hole k1.

The threaded through hole k5 of the roller assembly 13 may be threaded to the first screw of the adjusting bolt 15, the first screw can rotate around a center axis of the first screw to drive the roller assembly 13 to move in a length direction of the first screw, thus tensioning or loosening the belt 12. As such, the tightness of the belt 12 can be adjusted through the adjusting bolt 15 during the use of the roller adjusting structure 10 of the treadmill.

Figure 4:
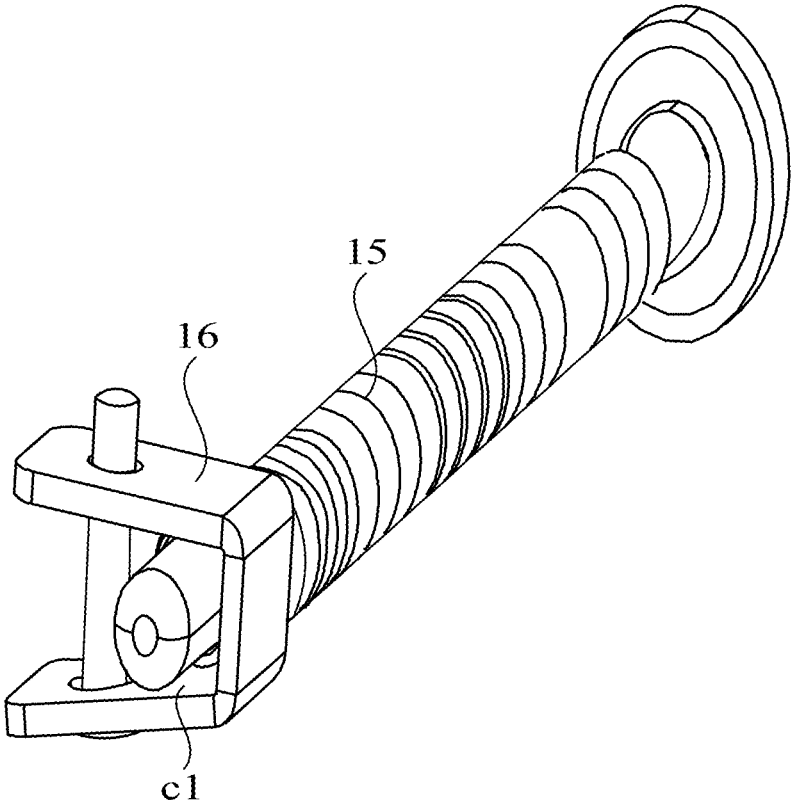
FIG. 4 is a schematic structural diagram of a clamping assembly and an adjusting bolt according to an embodiment of the present disclosure.

The clamping assembly 16 may be located at one side, away from the threaded through hole k5, of the second through hole k2, and connected to the running platform support 14. Referring to FIG. 3 and FIG. 4, FIG. 4 is a schematic structural diagram of a clamping assembly 16 and an adjusting bolt 15 according to an embodiment of the present disclosure. The clamping assembly 16 may be provided with a limit groove c1, a first end part of the adjusting bolt 15 is located in the limit groove c1, and a side wall of the first end part of the adjusting bolt 15 is abutted against a groove wall of the limit groove c1, thus making the clamping assembly 16 clamp the side wall of the first end part of the adjusting bolt 15. The first end part may be an end part, away from the first head of the adjusting bolt 15, of the first screw of the adjusting bolt 15. The clamping assembly 16 may be fixedly mounted on the running platform support 14, and the clamping assembly 16 can be configured to clamp the first end part, extending out of the second through hole k2, of the adjusting bolt 15. When the roller adjusting structure 10 of the treadmill is subjected to external vibration, the adjusting bolt 15 may be in a risk of slipping out, and the clamping assembly 16 can provide friction for the adjusting bolt 15 to resist the force when the adjusting bolt 15 slips out. As such, the clamping assembly 16 can be used to clamp the adjusting bolt 15 stably to limit the adjusting bolt 15, thus avoiding a loosening phenomenon of the adjusting bolt 15 caused by external vibration on the roller adjusting structure 10 of the treadmill or deformation of the running platform support 14, and improving the stability of the adjusting bolt 15.

Moreover, the frictional provided by the clamping assembly 16 to the adjusting bolt 15 by clamping the adjusting bolt 15 may be greater than a force applied when the adjusting bolt 15 is loosened, and less than a force applied to the adjusting bolt 15 by the user when adjusting a position of the roller assembly 13 through the adjusting bolt 15. Exemplary, the user can use a screwdriver or an electric screwdriver to rotate the adjusting bolt 15. As such, as the clamping assembly 16 and the adjusting bolt 15 are not fixedly connected, when the user adjusts the tightness of the belt 12 through the adjusting bolt 15, it is not necessary to disassemble the treadmill to separate the clamping assembly 16 from the adjusting bolt 15, but only to apply a force to the adjusting bolt 15 at the outer side of the corner-protecting structure 11 to rotate the adjusting bolt 15. That is, by clamping the adjusting bolt 15 stably by the clamping assembly 16, the convenience for a user to adjust the tightness of the belt 12 through the adjusting bolt 15 can be improved while improving the stability of the adjusting bolt 15, and thus the use experience of the user can be further improved.

In conclusion, an embodiment of the present disclosure provides a roller adjusting structure of a treadmill, which includes a corner-protecting structure, a roller assembly, a running platform support, an adjusting bolt, and a clamping assembly. The roller assembly is threaded to the adjusting bolt through a threaded through hole, the adjusting bolt rotates to drive the roller assembly to move to adjust the tightness of a belt. Moreover, the clamping assembly can be used to clamp the adjusting bolt stably to limit the adjusting bolt, thus avoiding a loosening phenomenon of the adjusting bolt caused by external vibration on the roller adjusting structure of the treadmill or deformation of the running platform support, which can improve the stability of the adjusting bolt, and achieve the effect of improving user experience.

It should be noted that the roller adjusting structure 10 of the treadmill may include multiple roller assemblies 13. In an embodiment of the present disclosure, a situation that two adjusting bolts 15 are respectively connected to both ends of one roller assembly 13 so as to adjust the tightness of the belt 12 through this roller assembly 13 is taken as an example for description.

The roller adjusting structure 10 of the treadmill may include multiple corner-protecting structures 11 which are located at both ends of the multiple roller assemblies 13, respectively.

In an exemplary embodiment, the roller adjusting structure 10 of the treadmill may also include four adjusting bolts 15. Two of the four adjusting bolts 15 are respectively connected to both ends of one roller assembly 13, and the other two adjusting bolts 15 are respectively connected to both ends of another roller assembly 13, thus adjusting the tightness of the belt 12 through these two roller assemblies 13. The number of the adjusting bolts 15 in the roller adjusting structure 10 of the treadmill is not limited in the embodiment of the present disclosure.

In an exemplary embodiment, the first screw rotating around its own center axis includes two conditions: rotating around a first direction, and rotating around a second direction. The first direction may be one of a clockwise rotating direction and a counterclockwise rotating direction, and the second direction is the other of the clockwise rotating direction and the counterclockwise rotating direction.

When the first screw of the adjusting bolt 15 rotates along the first direction around its own center axis, the first screw can drive the roller assembly 13 to move towards the running platform support 14, the belt 12 can be driven by the roller assembly 13 to be loosened. When the first screw of the adjusting bolt 15 rotates along the second direction around its own center axis, the first screw can drive the roller assembly 13 to move away from the running platform support 14, the belt 12 can be driven by the roller assembly 13 to be tensioned. It should be noted that the direction in which the first screw of the adjusting bolt 15 rotates clockwise and counterclockwise around its own center axis to drive the roller assembly 13 to move depends on a thread direction of the first screw and a thread direction in the threaded through hole k5 in the roller assembly 13.

It may be understood that the first end part of the adjusting bolt 15 refers to part of the screw body, away from one end of the first head, of the first screw in the adjusting bolt 15, and the first end part may have a preset length. Exemplary, the first end part of the adjusting bolt 15 has a length ranging from 2 cm to 5 cm.

Figure 5:
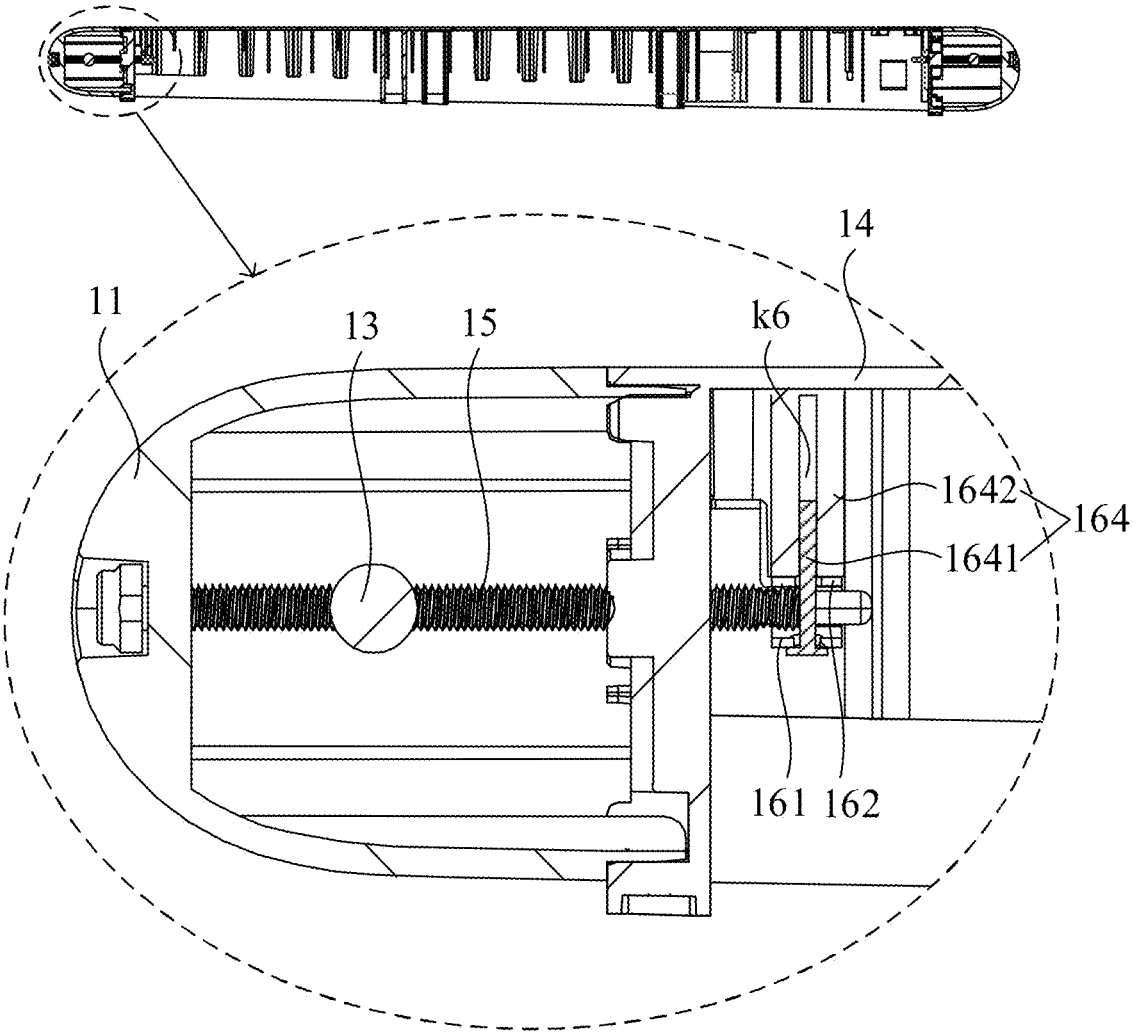
FIG. 5 is a schematic diagram of a sectional structure of a roller adjusting structure of a treadmill shown in FIG. 1 along B1-B2 position.
Figure 6:
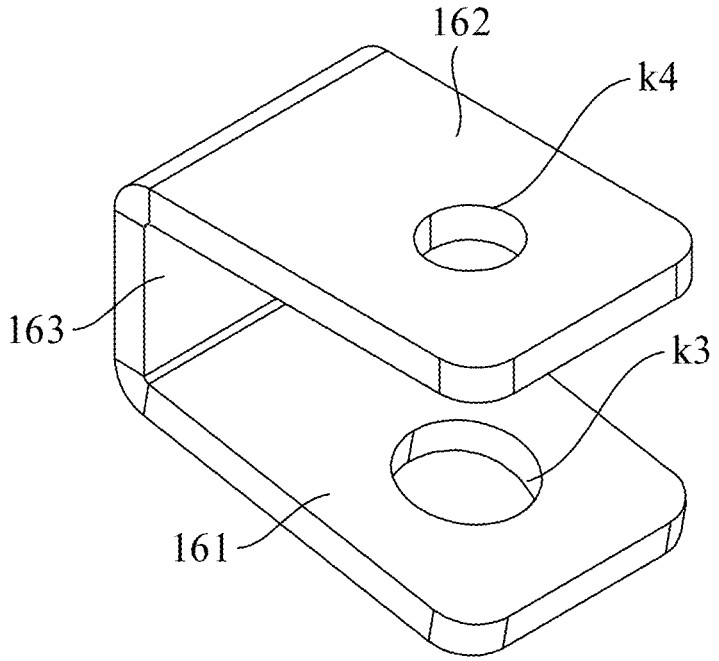
FIG. 6 is a schematic diagram of a connecting structure of a first clamp plate, a second clamp plate and a connecting plate according to an embodiment of the present disclosure.

Referring to FIG. 5 and FIG. 6, FIG. 5 is a schematic diagram of a sectional structure of a roller adjusting structure 10 of a treadmill shown in FIG. 1 along B1-B2 position; and FIG. 6 is a schematic diagram of a connecting structure of a first clamp plate 161, a second clamp plate 162 and a connecting plate 163 according to an embodiment of the present disclosure. In an alternative embodiment, the clamping assembly 16 may include a first clamp plate 161, a second clamp plate 162, a connecting plate 163, and a locking structure 164.

The first clamp plate 161 and the second clamp plate 162 may be respectively located at both sides of the first end part of the adjusting bolt 15, and both ends of the connecting plate 163 are respectively connected to the first clamp plate 161 and the second clamp plate 163 to form the limit groove. The locking structure 164 may be located at one side, away from the connecting plate 163, of the first end part of the adjusting bolt 15, and the locking structure 164 may be respectively connected to the first clamp plate 161 and the second clamp plate 162. The locking structure 164 can apply a force towards the second clamp plate 162 to the first clamp plate 161, or the locking structure 164 can apply a force toward the first clamp plate 161 to the second clamp plate 162. That is, both the first clamp plate 161 and the second clamp plate 162 can be tightened toward the adjusting bolt 15, such that the first clamp plate 161 and the second clamp plate 162 can clamp the adjusting bolt 15.

Figure 7:
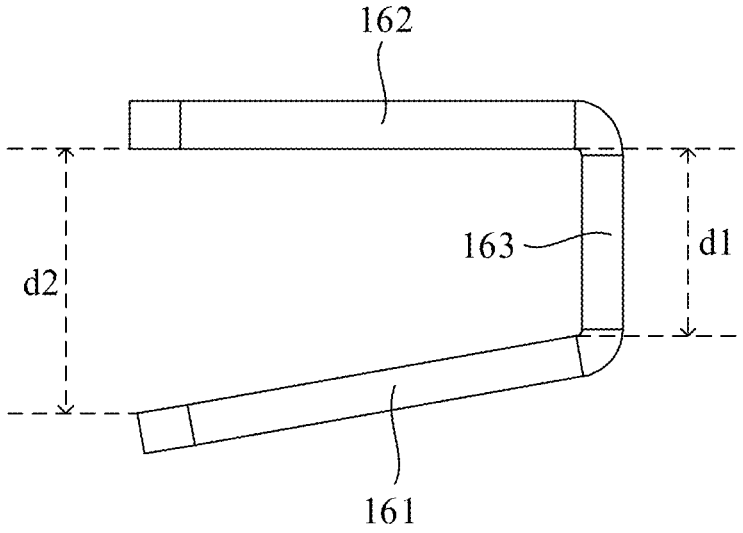
FIG. 7 is a schematic diagram of a connecting structure of a first clamp plate, a second clamp plate and a connecting plate according to an embodiment of the present disclosure.

Referring to FIG. 7, FIG. 7 is a schematic diagram of a connecting structure of a first clamp plate 161, a second clamp plate 162 and a connecting plate 163 according to an embodiment of the present disclosure. In an alternative embodiment, under the condition of not being locked by the locking structure, one end of the first clamp plate 161 may be fixedly connected to the connecting plate 163, and one end of the second clamp plate 162 may be fixedly connected to the connecting plate 163. A shortest distance d1 between one end of the first clamp plate 161 and one end of the second clamp plate 162 may be less than or equal to a diameter of the first end part of the adjusting bolt 15, and the diameter of the first end part of the adjusting bolt 15 is less than or equal to a shortest distance d2 between the other end of the first clamp plate 161 and the other end of the second clamp plate 162. As such, the first clamp plate 161, the second clamp plate 162 and the connecting plate 163 can form a U-shaped clamping structure, that is, the limit groove c1 enclosed by the first clamp plate 161, the second clamp plate 162 and the connecting plate 163 may be U-shaped, and the limiting groove c1 has a notch and a groove bottom corresponding to each other, the shortest distance d1 between one end of the first clamp plate 161 and one end of the second clamp plate 162 may be the size of the groove bottom, the shortest distance d2 between the other end of the first clamp plate 161 and the other end of the second clamp plate 162 may be the size of the notch, and the size of the notch is larger, such that the difficulty for the user to extend the first end part of the adjusting bolt 15 into the limit groove c1 of the clamping assembly 16 can be reduced.

Exemplary, the shortest distance d1 between one end of the first clamp plate 161 and one end of the second clamp plate 162 is less than or equal to a diameter of the first screw of the adjusting bolt 15, and the shortest distance d2 between the other end of the first clamp plate 161 and the other end of the second clamp plate 162 may be greater than or equal to the diameter of the first screw of the adjusting bolt 15.

Referring to FIG. 5 and FIG. 6, in an alternative embodiment, the first clamp plate 161 may be provided with a third through hole k3, and the second clamp plate 162 may be provided with a fourth through hole k4. The locking structure 164 may include a first bolt 1641, and a fixing member 1642, and the fixing member 1642 may be located at one side, away from the first clamp plate 161, of the second clamp plate 162, and the fixing member 1642 may be provided with a first mounting hole k6. The first bolt 1641 can pass through the third through hole k3 and the fourth through hole k4, and an end part of the first bolt 1641 extends into the first mounting hole k6 to be threaded to the fixing member 1642. The first bolt 1641 may include a second head and a second screw. The second head of the first bolt 1641 may be located at one side, away from the fourth through hole k4, of the third through hole k3, and the second screw may be located in the third through hole k3, the fourth through hole k4 and the first mounting hole k6. As such, the first clamp plate 161 and the second clamp plate 162 can be tightened stably by the first bolt 1641.

Figure 8:
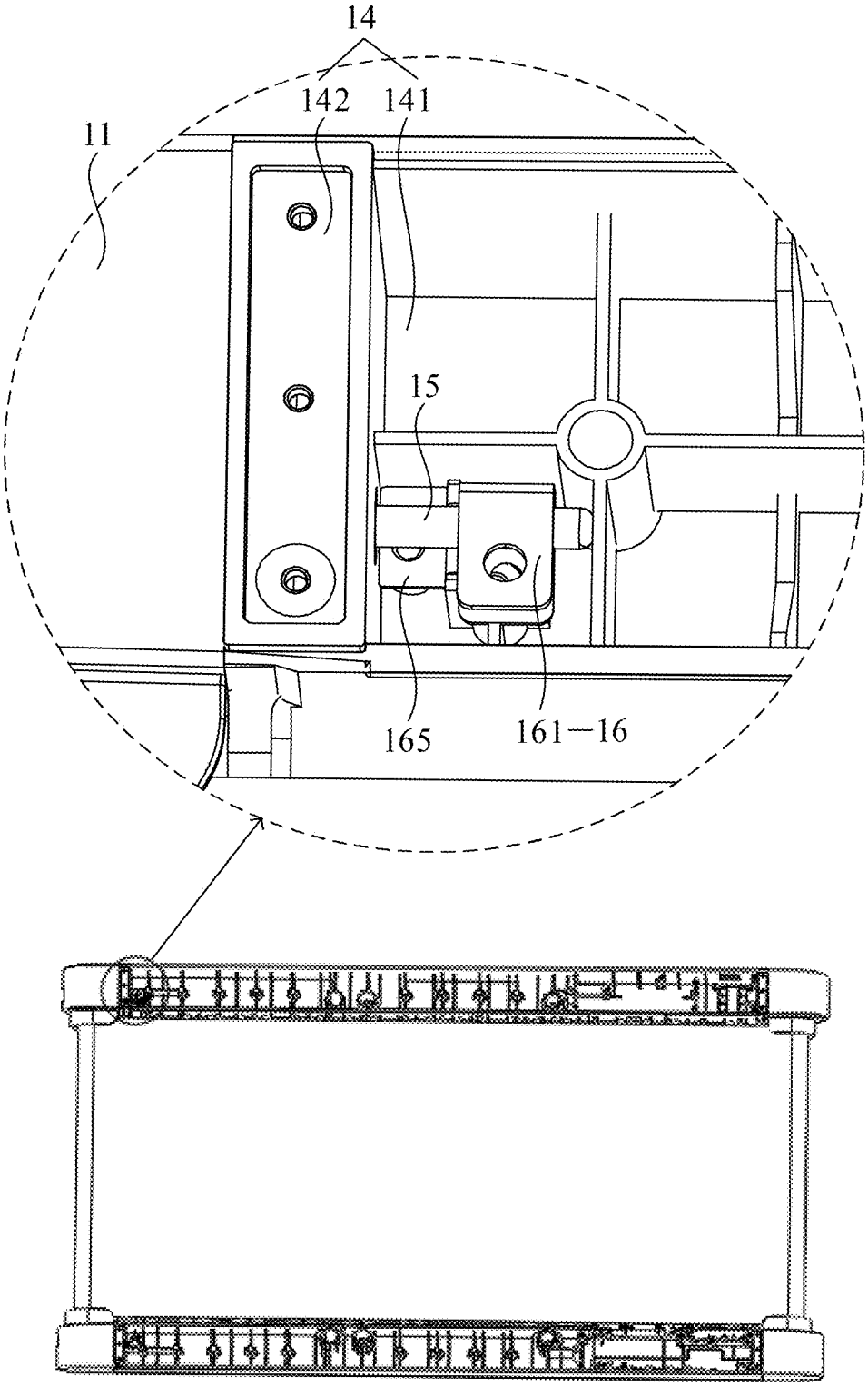
FIG. 8 is a schematic structural diagram of another roller adjusting structure of a treadmill according to an embodiment of the present disclosure.
Figure 9:
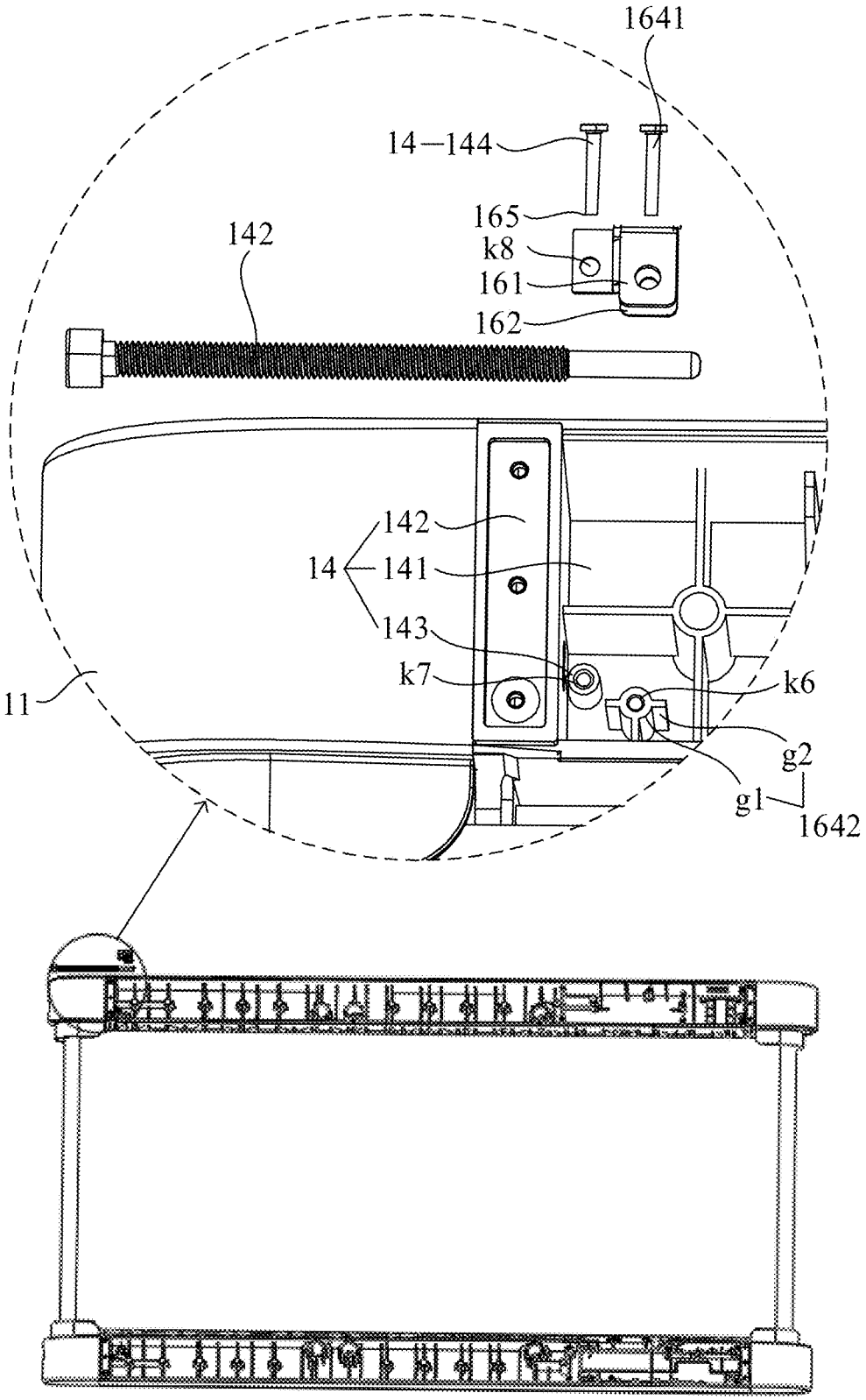
FIG. 9 is a schematic diagram of an exploded structure of a roller adjusting structure of a treadmill shown in FIG. 8.

Referring to FIG. 5, FIG. 8 and FIG. 9, FIG. 8 is a schematic structural diagram of a roller adjusting structure 10 of a treadmill according to another embodiment of the present disclosure, and FIG. 9 is a schematic diagram of an exploded structure of a roller adjusting structure 10 of a treadmill shown in FIG. 8. In an alternative embodiment, the fixing member 1642 may include a tubular post g1, the first mounting hole k6 is formed in the tubular post g1. One end, away from the second clamp plate 162, of the tubular post g1 is fixedly connected to the running platform support 14, and one end, close to the second clamp plate 162, of the tubular post g1 is abutted against the second clamp plate 162. The tubular post g1 may be bonded or welded to the running platform support 14, or the tubular post g1 and the treadmill support 14 may be an integrated structure manufactured by an inserted injection molding process. The inserted injection molding process refers to a molding process of injecting molten resin or plastic after filling a metal insert prepared in advance into a mold, and then bonding and curing the molten resin or plastic with the metal insert to make an integrated product. As such, the first bolt 1641 may be connected to the first clamp plate 161, the second clamp plate 162 and the tubular post g1, the first bolt 1641 and the tubular post g1 can be configured to fix the first clamp plate 161 and the second clamp plate 162 to the running platform support 14 while locking the first clamp plate 161 and the second clamp plate 162.

In an alternative embodiment, the fixing member 1642 may also be a nut in fit with the first bolt 1641.

Referring to FIG. 9, in an alternative embodiment, the fixing member 1642 may further include multiple reinforcing ribs g2. The reinforcing ribs g2 are located at an outer side of the tubular post g1, and connected to an outer side wall of the tubular post g1 and the running platform support 14, respectively. The reinforcing rib g2 can enhance the strength and stiffness of the tubular post g1 without increasing a wall thickness of the tubular post g1, on the one hand, the deformation of the tubular post g1 can be avoided, on the other hand, the tubular post g1 may be lighter in weight, and further, the fixing member 1642 may be enabled to have stronger overall strength and stiffness under the condition of light weight.

The outer side of the tubular post g1 is provided with multiple reinforcing ribs g2, and the number of the reinforcing ribs g2 can be adjusted according to a design strength of the fixing member 1642. When the design strength of the fixing member 1642 is large, the number of the reinforcing ribs g2 can be appropriately increased to improve the structural strength of the tubular post g1, avoid the deformation of the tubular post g1, and further improve the structural strength of the fixing member 1642.

Alternatively, the multiple reinforcing ribs g2 are uniformly distributed around a circumferential direction of the tubular post g1, making the multiple reinforcing ribs g2 bear force uniformly. The reinforcing rib g2 may be fixedly connected to the outer side wall of the tubular post g1, and may also be fixedly connected to the running platform support 14. Exemplary, the reinforcing ribs g2 can be welded or bonded to the outer side wall of the tubular post g1. Alternatively, the reinforcing rib g2, the tubular post g1 and the running platform support 14 may be an integrated structure manufactured through the inserted injection molding process.

Figure 10:
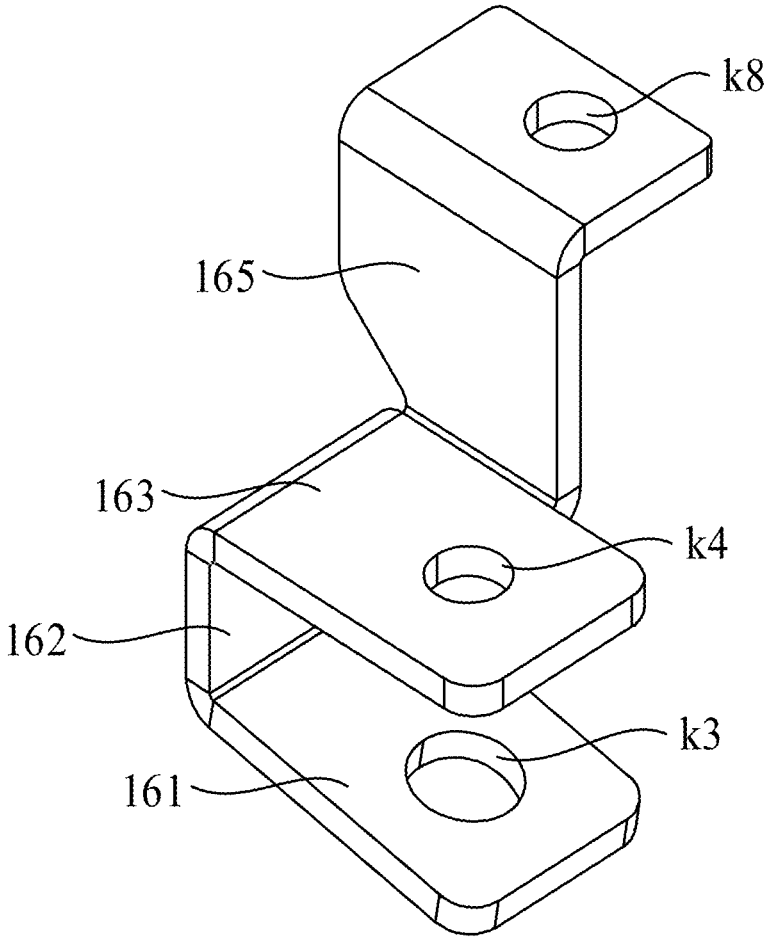
FIG. 10 is a schematic structural diagram of another clamping assembly according to an embodiment of the present disclosure.

Referring to FIG. 8, FIG. 9 and FIG. 10, FIG. 10 is a schematic structural diagram of another clamping assembly 16 according to an embodiment of the present disclosure, and the locking structure 164 of the clamping assembly 16 is not shown in the clamping assembly 16 shown in FIG. 10. In an alternative embodiment, the running platform support 14 may include a base portion, and support portions located at both sides of the base portion. The belt 12 is wrapped around the base portion, the support portion may include a top plate 141 and a side plate 142 connected to each other, and the top plate 141 and the side plate 142 form an accommodating space. The clamping assembly 16 may be arranged in the accommodating space, and the clamping assembly 16 may also include a mounting portion 165. One end of the mounting portion 165 is connected to the first clamp plate 161 or the second clamp plate 162, and the other end of the mounting portion 165 is connected to the top plate 141 or the side plate 142. Exemplary, the second clamp plate 162 is located at one side, close to the top plate 141, of the first clamp plate 161, one end of the mounting portion 165 is connected to the second clamp plate 162, and the other end of the mounting portion 165 is connected to the top plate 141. As such, the clamping assembly 16 can be fixed to the running platform support 14 by the mounting portion 165, which can further improve the stability of the clamping assembly 16. The other end of the mounting portion 165 can be welded, bonded or bolted to the top plate 141.

The second through hole k2 may be formed in the side plate 142, and the first end part of the adjusting bolt 15 may also extend into the accommodating space through the second through hole k2.

Referring to FIG. 8, FIG. 9 and FIG. 10, in an alternative embodiment, the running platform support 14 may also include a support seat 143 and a second bolt 144. The support seat 143 is fixedly connected to the top plate 141, the support seat 143 is provided with a second mounting hole k7, the second bolt 144 is mounted in the second mounting hole k7 of the support seat 143, and the second bolt 144 is also connected to the mounting portion 165, thus fixing the mounting portion 165 to the support seat 143. Exemplary, the mounting portion 165 is provided with a fifth through hole k8, one end of the second bolt 144 passes through the fifth through hole k8 to fix the mounting portion 165 to the support seat 143, and the support seat 143 can be welded or bonded to the top plate 141. Alternatively, the side plate 142, the top plate 141 and the support seat 143 may be an integrated structure manufactured through an inserted injection molding process. By arranging the support seat 143 for mounting the second bolt 144, punching holes in the top plate 141 of the running platform support 14 can be avoided, and the overall strength and aesthetics of the running platform support 14 can be improved.

In an alternative embodiment, each of the first clamp plate 161 and the second clamp plate 162 may be an elastic member, the first clamp plate 161 is abutted against one side of the first end part of the adjusting bolt 15, and the second clamp plate 162 is abutted against the other side of the first end part of the adjusting bolt 15. The first clamp plate 161 and the second clamp plate 162 can clamp the adjusting bolt 15 under the elastic force. As such, when the roller adjusting structure 10 of the treadmill is subjected to external vibration and the first bolt 1641 is loosened, the clamping assembly 16 can also clamp the adjusting bolt 15 by the elastic force of the first clamp plate 161 and the second clamp plate 162, which can further improve the stability of the adjusting bolt 15.

It should be noted that in an embodiment of the present disclosure, the first bolt 1641 is not shown in FIG. 3 and FIG. 8, the second bolt 144 is not shown in FIG. 8, and the roller adjusting structure of the treadmill shown in FIG. 8 and FIG. 9 is a schematic structural diagram of a back surface of a roller adjusting structure of the treadmill shown in FIG. 1.

In conclusion, an embodiment of the present disclosure provides a roller adjusting structure of a treadmill, which includes a corner-protecting structure, a roller assembly, a running platform support, an adjusting bolt and a clamping assembly, The roller assembly is threaded to the adjusting bolt by a threaded through hole, the adjusting bolt rotates to drive the roller assembly to move to adjust the tightness of a belt. Moreover, the clamping assembly can be used to clamp the adjusting bolt stably to limit the adjusting bolt, thus avoiding a loosening phenomenon of the adjusting bolt caused by external vibration on the roller adjusting structure of the treadmill or deformation of a running platform support, which can improve the stability of the adjusting bolt, and achieve the effect of improving user experience.

The embodiment of the present disclosure further provides a treadmill, which may include the roller adjusting structure in any of above embodiments.

In the present disclosure, the terms "first", "second", "third" and "fourth" are used for descriptive purposes only and are not to be construed as indicating or implying relative importance. The term "a plurality of" means two or more, unless otherwise specifically defined.

The above is only the optional embodiment of the present disclosure, and is not used to limit the present disclosure. Any modification, equivalent substitution, improvement, etc. made within the spirit and principle of the present disclosure should be included in the scope of protection of the present disclosure.

What is claimed is:

1. A roller adjusting structure of a treadmill, comprising a corner-protecting structure, a roller assembly, a running platform support, and an adjusting bolt;

wherein the corner-protecting structure is arranged at one side of one end of the roller assembly, the corner-protecting structure is provided with a first through hole, and one end of the roller assembly is provided with a threaded through hole;

the running platform support is located at one side, away from the corner-protecting structure, of the roller assembly, and the running platform support is provided with a second through hole;

the adjusting bolt passes through the first through hole, the threaded through hole and the second through hole in turn, and a first end part of the adjusting bolt extends out of the second through hole;

wherein the roller adjusting structure of the treadmill further comprises a clamping assembly, which is located at one side, away from the threaded through hole, of the second through hole and connected to the running platform support; the clamping assembly is provided with a limit groove, the first end part of the adjusting bolt is located in the limit groove, and a side wall of the first end part is abutted against a groove wall of the limit groove, thus enabling the clamping assembly to clamp the side wall of the first end part of the adjusting bolt.

2. The roller adjusting structure of a treadmill according to claim 1, wherein the clamping assembly comprises a first clamp plate, a second clamp plate, a connecting plate, and a locking structure;

the first clamp plate and the second clamp plate are respectively located at both sides of the first end part of the adjusting bolt, and two ends of the connecting plate are respectively connected to the first clamp plate and the second clamp plate to form the limit groove; and the locking structure is located at one side, away from the connecting plate, of the first end part of the adjusting bolt, and the locking structure is respectively connected to the first clamp plate and the second clamp plate.

3. The roller adjusting structure of a treadmill according to claim 2, wherein one end of the first clamp plate is fixedly connected to the connecting plate, and one end of the second clamp plate is fixedly connected to the connecting plate;

under a condition of not being locked by the locking structure, a shortest distance between one end of the first clamp plate and one end of the second clamp plate is less than or equal to a diameter of the first end part of the adjusting bolt, and the diameter of the first end part of the adjusting bolt is less than or equal to a shortest distance between the other end of the first clamp plate and the other end of the second clamp plate.

4. The roller adjusting structure of a treadmill according to claim 2, wherein the first clamp plate is provided with a third through hole, and the second clamp plate is provided with a fourth through hole;

the locking structure comprises a first bolt and a fixing member, the fixing member is located at one side, away from the first clamp plate, of the second clamp plate, and the fixing member is provided with a first mounting hole;

the first bolt passes through the third through hole and the fourth through hole, and an end part of the first bolt extends into the first mounting hole to be threaded to the fixing member.

5. The roller adjusting structure of a treadmill according to claim 4, wherein the fixing member comprises a tubular post, the first mounting hole is formed in the tubular post, one end, away from the second clamp plate, of the tubular post is fixedly connected to the running platform support, and one end, close to the second clamp plate, of the tubular post is abutted against the second clamp plate.

6. The roller adjusting structure of a treadmill according to claim 5, wherein the fixing member further comprises a plurality of reinforcing ribs, and the reinforcing ribs are located at an outer side of the tubular post, and connected to an outer side wall of the tubular post and the running platform support, respectively.

7. The roller adjusting structure of a treadmill according to claim 2, wherein the roller adjusting structure of the treadmill further comprises a belt, the running platform support comprises a base portion, and support portions located at both sides of the base portion; the belt is wrapped around the base portion, each support portion comprises a top plate and a side plate connected to each other, and the top plate and the side plate form an accommodating space;

the clamping assembly is arranged in the accommodating space, and the clamping assembly further comprises a mounting portion, one end of the mounting portion is connected to the first clamp plate or the second clamp plate, and the other end of the mounting portion is connected to the top plate or the side plate.

8. The roller adjusting structure of a treadmill according to claim 7, wherein the running platform support further comprises a support seat, and a second bolt; the support seat is fixedly connected to the top plate, the support seat is provided with a second mounting hole, the mounting portion is provided with a fifth through hole, and the second bolt is mounted in the second mounting hole of the support seat; and one end of the second bolt passes through the fifth through hole to fix the mounting portion to the support seat.

9. The roller adjusting structure of a treadmill according to claim 2, wherein each of the first clamp plate and the second clamp plate is an elastic member, the first clamp plate is abutted against one side of the first end part of the adjusting bolt, and the second clamp plate is abutted against the other side of the first end part of the adjusting bolt.

10. A treadmill, comprising the roller adjusting structure of a treadmill according to claim 1.

* * * * *